US005531189A

United States Patent [19]

Shelton et al.

[11] Patent Number: 5,531,189

[45] Date of Patent: Jul. 2, 1996

[54] AUTOMATED DAMPING PORT RODDER

[75] Inventors: Jeff L. Shelton; Kevin J. Stallings, both of Jacksonville; Thomas H. Hogan, Anniston, all of Ala.

[73] Assignee: Drayton Corporation, Jacksonville, Ala.

[21] Appl. No.: 304,402

[22] Filed: Sep. 12, 1994

[51] Int. Cl.[6] ..... F22B 37/18

[52] U.S. Cl. ..... 122/379; 122/6.5; 15/104.03; 15/104.05; 15/104.061; 110/182.5

[58] Field of Search ..... 122/6.5, 379; 15/104.03, 15/104.05, 104.61; 110/182.5

[56] References Cited

U.S. PATENT DOCUMENTS 5,070,823 12/1991 Ackerman et al. ..... 122/379

5,307,745 5/1994 Higgins et al. ..... 110/182.5

5,351,631 10/1994 Hill et al. ..... 110/182.5

*Primary Examiner*—Henry A. Bennett

*Assistant Examiner*—Siddharth Ohri

*Attorney, Agent, or Firm*—Veal & Marsh

[57] ABSTRACT

The present invention uses a pivotally mounted damper to cover the port and provide damping to the boiler furnace. The damper is aligned with and superjacent the rodding mechanism and is supported intermediate the port and the pivotal mounting by a linkage which raises and lowers the damper responsive to linear motion of the rodding mechanism.

19 Claims, 5 Drawing Sheets

AUTOMATED DAMPING PORT RODDER

BACKGROUND

The present invention relates to kraft chemical recovery boilers and more particularly to the air intake ports of such boilers. In even greater particularity, the present invention relates to the maintenance of such air ports to facilitate the improved efficiency of such boilers. In still greater particularity the present invention relates to apparatus for damping selected ones of the primary, secondary, or tertiary air ports of the boiler such that automated rodding apparatus may be employed to clear the port on a scheduled or as needed basis.

Many black liquor recovery boilers experience problems with unscheduled shutdowns due to excessive build-up on the heat transfer surfaces of carryover or fume particles. The carryover particles are black liquor droplets entrained by the combustion gases carried into the upper furnace. The fume particles are formed from the condensation of sodium and related compounds, which in turn are emitted in gaseous form from the burning liquid droplets or smelt bed. Generally, plugging in the superheater and boiler bank is normally formed by deposits of carryover rather than fume. Thus, the quantity of carryover present in the upper furnace has a significant impact on the pluggage rate.

The Particulator Carryover Monitoring System manufactured by Quadtek, Inc. uses an infrared camera which is installed in the upper furnace facing the superheater tubes in a region in which the air flow patterns are constant, avoiding recirculation zones. The video signal from the upper furnace camera is digitized under the control of a computer which counts particles that cross a horizontal line in the middle of the monitor screen. The Particulator's image processor superimposes two (2) arrows on the monitor which defines the line that the computer scans. The particles that pass between the arrows are counted. The accumulated particle counts are displayed in counts per second (CPS) and counts per minute (CPM) .

A typical recovery boiler operating at a constant firing rate shows significant carryover fluctuation on an hourly basis. The hourly increases are believed to be associated with manual primary air port rodding. The average primary air pressure without continuous rodding was 3.4" $H_2O$ with an average deviation of 0.5" $H_2O$. During continuous manual rodding, primary air pressure was reduced to an average of 2.53" $H_2O$ with an average standard deviation of 0.145" $H_2O$.

The primary air accounts for approximately sixty (60) percent of the combustion air. As the ports experience smelt build-up, the air flow rate changes by as much as ten (10) percent. When the smelted ports are manually rodded on two (2) hour intervals the boiler experiences a surge of primary air. This surge can cause particulate from the char bed to be entrained into the flue gas because of the sweeping action of the primary air over the char bed and leads to increased carryover and char bed shape changes. The surges in primary air were eliminated during continuous manual port rodding resulting in a substantial reduction in carryover and a stabilization of the primary air pressure. The frequency of the manual rodding is dependent upon the physical and operational characteristics of the boiler.

Thus, although the advantages of automatic rodding are known, the practice of automatic rodding is not universal and has been impeded by the necessity to provide dampers in the air flow path through an associated wind box to the boiler ports. The known dampers are as shown in FIG. 7 of the drawings submitted herewith and are such that the automatic rodding devices are incompatible with automatic damping. That is to say in known damped systems, the rodding must be performed in a manual or at best semi automated mode because, as seen in FIG. 7 the operator, manually or with an actuator A, must move the damper D using lever L from intermediate the boiler port P and the access port R in the wind box W to enable the rodding device to gain access to the port P for cleaning. Alternatively the damper must be positioned distal the port and thus loses some of its efficiency by virtue of its remote location.

SUMMARY OF THE INVENTION

It is the principal object of the invention to enable the continuous automated rodding of boiler ports wherein a damper is positioned adjacent the port.

Another object of the invention is to provide an automated damper mechanism which retracts to a non-interfering position upon actuation of an associated rodding mechanism and returns to a preset damping position upon retraction of the rodding mechanism.

It is the ultimate object of the invention to operatively combine the damping mechanism and rodding mechanism to improve the efficiency of the recovery boiler and to reduce the carryover particulate content.

These and other objects of the invention and advantages derived thereby are accomplished through the novel combination of elements which link the damper and the rodding mechanism. As set out more specifically hereinafter, the present invention uses a pivotally mounted damper to cover the port and provide damping to the boiler furnace. The damper is aligned with and superjacent the rodding mechanism and is supported intermediate the port and the pivotal mounting by a linkage which raises and lowers the damper responsive to linear motion of the rodding mechanism.

BRIEF DESCRIPTION OF THE DRAWINGS

Apparatus embodying features of my invention are depicted in the accompanying drawings which form a portion of this disclosure and wherein.

DESCRIPTION OF A PREFERRED EMBODIMENT

Figure 1:
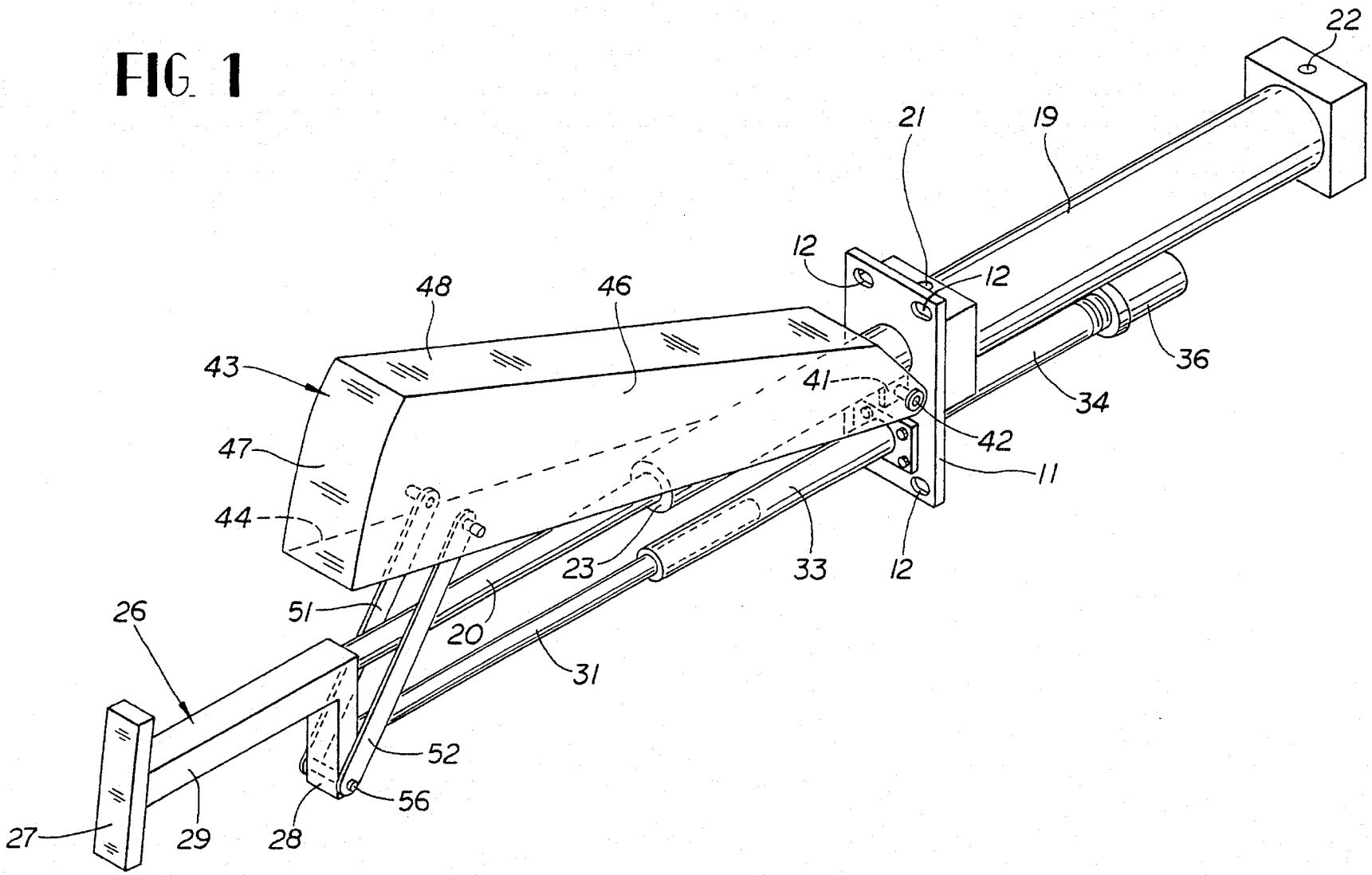
FIG. 1 is a perspective view of the apparatus.
Figure 2:
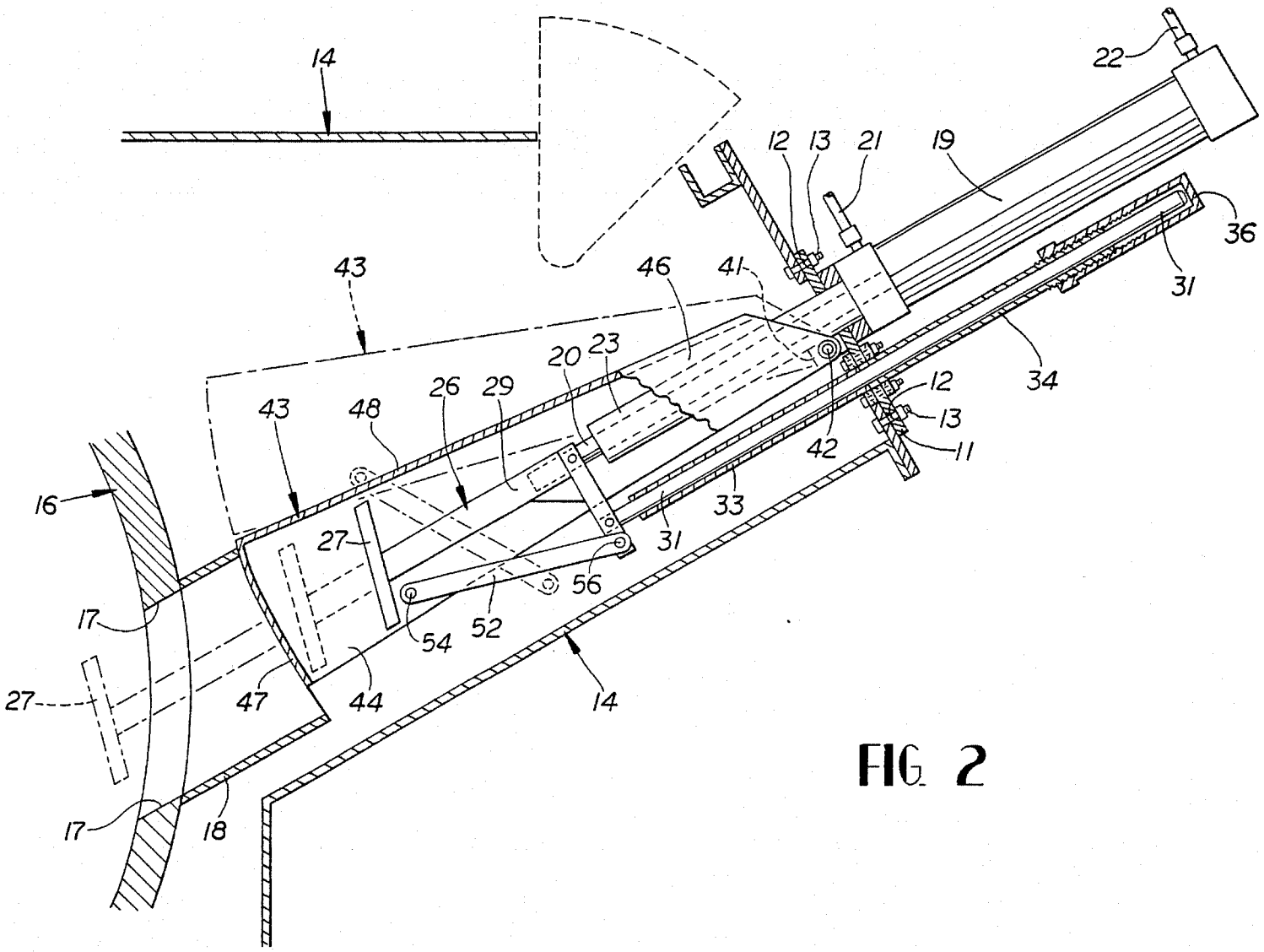
FIG. 2 is a sectional view of a wind box of a boiler adjacent a port depicting the apparatus in retracted position with the damper proximal the port and depicting in phantom the position of the damper and rodding mechanism when actuated.
Figure 3:
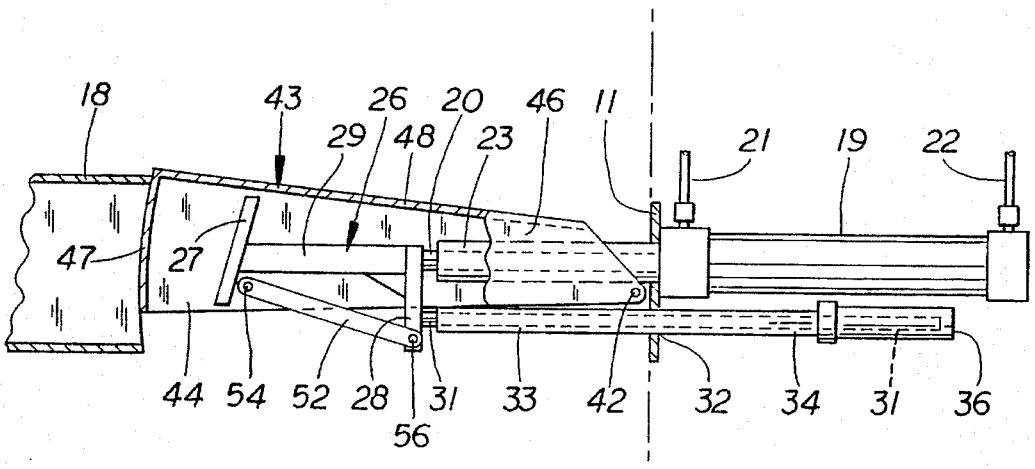
FIG. 3 is a side elevational view of the apparatus with the damper shown partially in section and in the port damping position.

Referring to the drawings for a clearer understanding, it may be seen in FIG. 1, that the invention is amenable to integration into existing recovery boilers and is a system which will be readily installed. In FIGS. 1 & 2, the invention is depicted with a mounting flange 11, which has formed therein a plurality of apertures 12, through which a plurality of fasteners 13 such as rivets or bolts may extend. The fasteners 13 are used to mount the invention to a wind box 14 of a recovery boiler. As is well known the wind box is an air conduit or manifold type structure on the exterior of the boiler through which air is delivered to the ports of the boiler and is usually fabricated from sheet metal of appropriate grade and thickness. Prior art wind boxes included rodding ports in alignment with the boiler ports such that a long rod could be manually inserted through the wind box to clean the boiler port, hence the term "rodding" refers to such a cleaning action. In FIG. 2 the boiler wall is depicted in part at 16 with the boiler port at 17, and a port sleeve 18 extending outwardly from the boiler wall 16.

Flange 11 has affixed thereto, externally of the wind box 14, a suitable linear actuator 19, preferably a pneumatic cylinder having a piston rod 20 which is extendible and retractable responsive to a remote source of supply connected by appropriate valves and fittings as is well known in the art. Conduits 21 and 22 provide the needed communication with the remote source for actuation of the rod 20. Extending within the wind box 14, concentric with the rod 20 is a piston rod sleeve 23. It is to be understood the that the actuator may be connected to the mounting flange 11 by conventional means and that the rod 20 of the actuator is to be of sufficient length to extend through the sleeve 23 when in the retracted position. The free end of the rod 23 has affixed thereto a plunger assembly 26, which includes an inclined cleaning tip 27, oriented cooperatively with the dimensions of the boiler port 17. That is to say, if the boiler port 17 is substantially vertically oriented having an elongated shape then the cleaning tip 27 is similarly shaped and oriented. In the embodiment of FIGS. 1–5 the plunger assembly includes a depending leg 28 and an extension leg 29, with the depending leg at a fixed angle relative to the extension leg 29, which is aligned with the rod 20. Affixed to the depending leg 28 at a lower end thereof is a guide rod 31 which extends parallel to the rod 20 through an opening 32 in the flange 11. Affixed to the flange 11 concentric with opening 32 and extending within the wind box 14 is a guide tube 33 which is concentric with guide rod 31 and receives the guide rod 31 in sliding relation therewithin. Externally of flange 11 and affixed thereto is an adjustment tube 34, which is also concentric with opening 32 and coaxial with guide rod 31, such that the rod 31 is constrained to reciprocate axially within the guide tube and the adjustment tube 34. Adjustment tube 34 is externally threaded at the end thereof distal the flange 11, and an adjustment nut 36 threadedly engaged thereon. Nut 36 is actually in the form of a closed end cylinder and is of sufficient length to extend coaxially about adjustment tube 34 for several inches depending upon the degree of engagement of the threads thereon. Guide rod 31 is of sufficient length to abut the closed end of the adjustment nut 36 when ever the nut is engaged on the adjustment tube 34.

Supported on the flange 11 is a set of bearings 41 which in turn rotatably support a shaft 42 within wind box 14 subjacent rod sleeve 23 and above aperture 32. Shaft 42 lies in a plane perpendicular to the travel of rod 20 and supports on its outer ends a damper assembly 43. Damper assembly 43 includes a pair of elongated side members 44 and 46 which may be plates or walls or may be tubular or spar-like in construction. The side members are pivotally connected to the shaft 42 and extend from the flange inwardly within the wind box 14 toward the boiler wall. Affixed to side members distal the shaft 42 is a damper plate 47 which is similar in shape to the damper plates of the prior art in that it may be arcuate dimensioned such that it will obscure the boiler port 17 in the manner of a conventional damper. A top member 48 or plate may be affixed to side members 44 and 46 and plate 47 to form a damper shroud or to provide reinforcement to the assembly.

As shown in FIGS. 2–5, damping plate 47 is movably supported proximal the port 17 or an associated port sleeve 18. Support and movement relative to the boiler port is provided by a pair of damper links 51 and 52 which are individually mounted to side members 44 and 46 by pivot pins 53 and 54. The lower ends of the damper links are pivotally mounted to depending leg 28 by a pin 56. The location of pins 53–56 on the associated structures and the length of the links 51 & 52 are selected such that when the rod 20 is retracted to its rest position the damper assembly 43 is supported on the links at its lowermost position. At this position it should also be noted that guide rod 31 is in its fully retracted position and abuts adjustment nut 36. Variation of the degree of engagement of the nut 36 will vary the retraction of guide rod 31 from within the wind box thus serving to vary the rest position of rod 20 and puncher assembly 26. In as much as the links 51 and 52 are supported on the puncher assembly, such variation will result in the damper plate 47 being supported in its rest position at a corresponding open or "damping" relationship with the port 17. Accordingly, adjustment nut and sleeve may be calibrated and appropriately marked to enable an operator to adjust the damping position of the damper from the exterior of the wind box.

Figure 4:
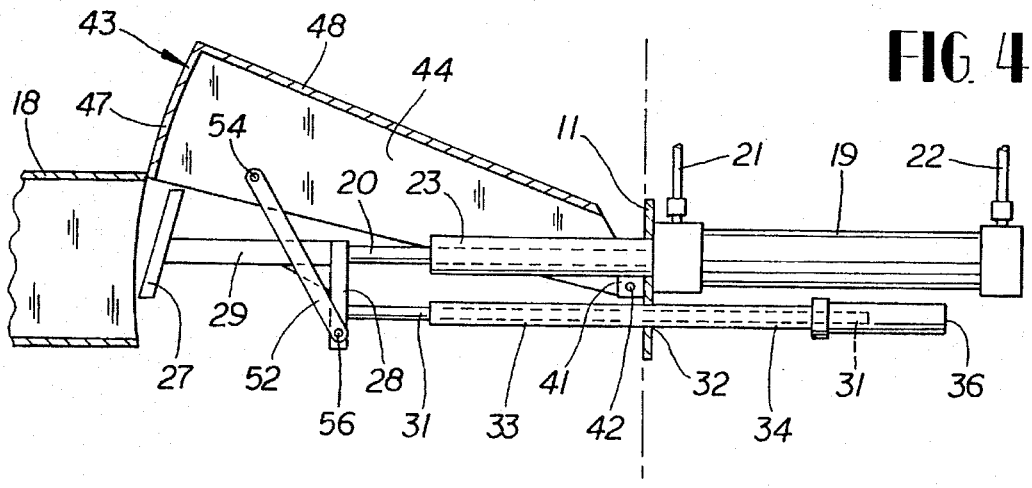
FIG. 4 is a side elevational view of the apparatus as in FIG. 3 with the rodding mechanism in mid-stroke.
Figure 5:
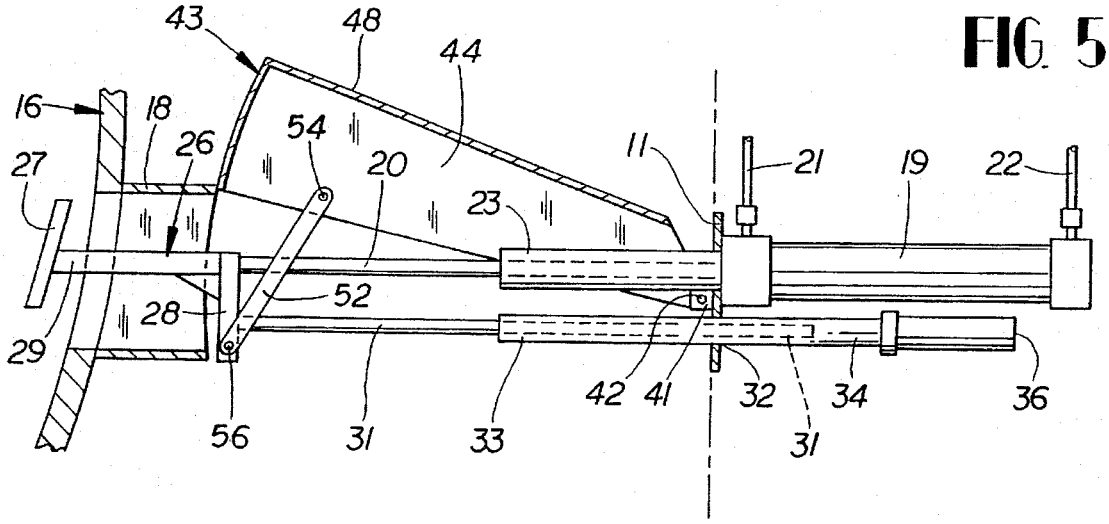
FIG. 5 is a side elevational view of the apparatus as in FIG. 3 with the rodding mechanism extending within the port.

Of critical importance in selecting the length and mounting position of links 51 and 51 is the relative position of damping plate 47 and cleaning tip 27 as the tip reaches the throat of the port or sleeve 18 as shown in FIG. 4. The links must be mounted such that linear movement of the tip toward the port causes the damper assembly to pivot upwardly about shaft 42 to provide clearance for the tip to enter the port and dislodge any smelt accumulation therein as shown in FIG. 5. Retraction of the rod 20 and tip 27 returns the assembly to its lowered damping position with the guide rod 31 and nut 34 serving as the retraction stop.

Figure 6:
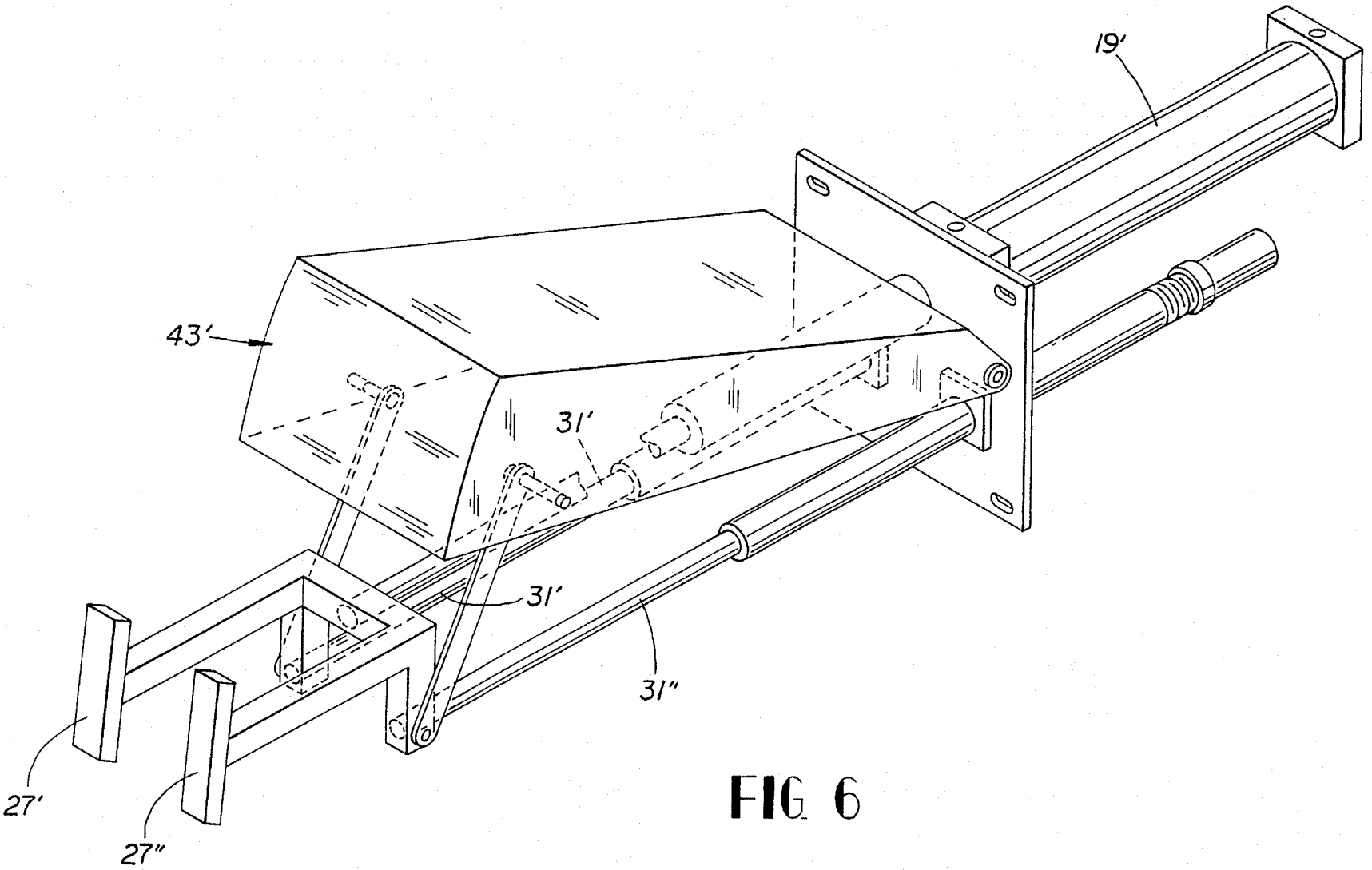
FIG. 6 is a perspective view of a multi-port system.
Figure 7:
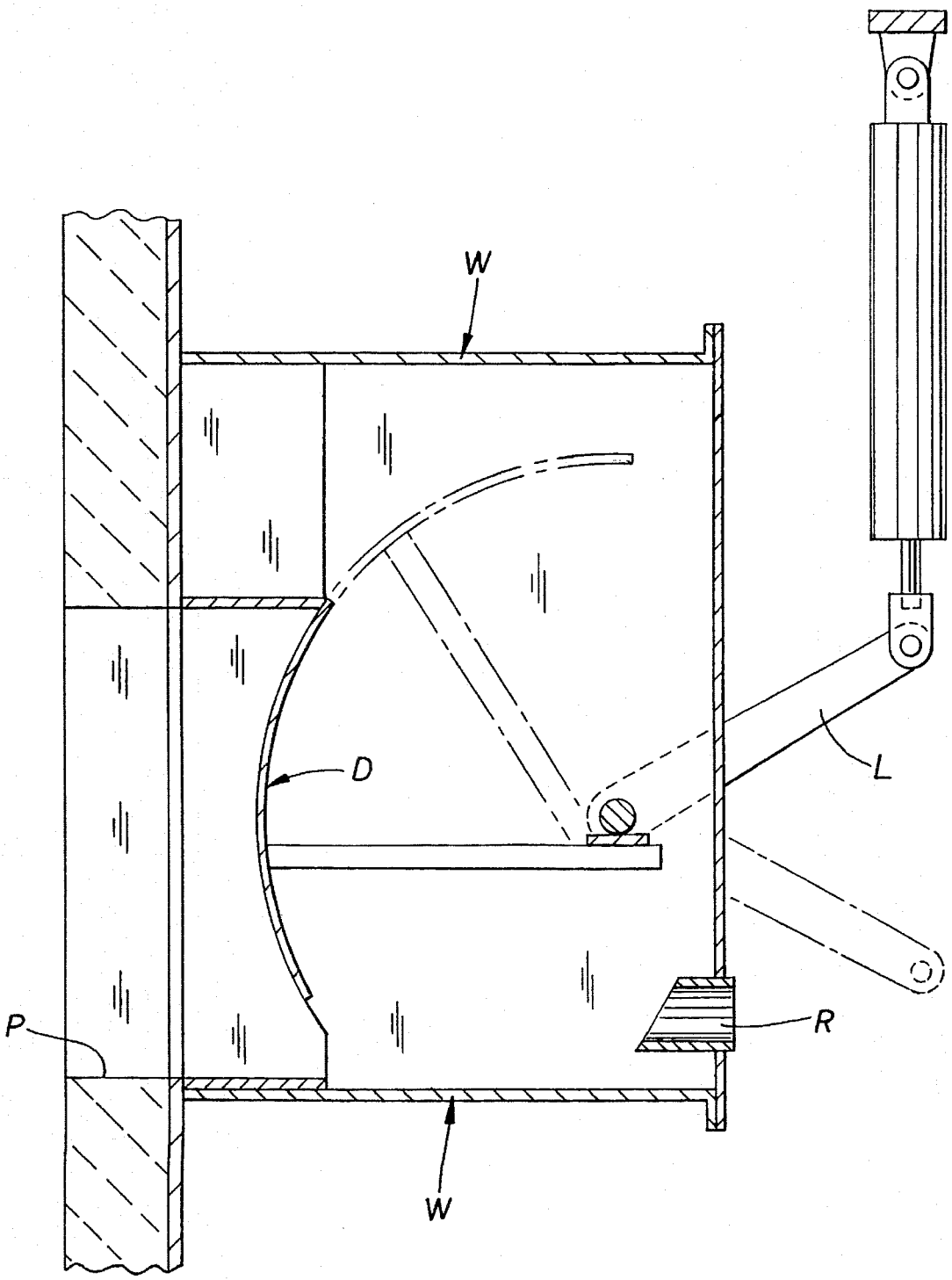
FIG. 7 Prior Art
FIG. 7 is a side elevational view of a prior art damper in section.

FIG. 6 depicts an embodiment wherein a pair of adjacent ports are damped by a common damping assembly 43' and individual cleaning tips 27' and 27" are moved into and out of registry with the ports for cleaning. A common actuator 19' urges the components through their respective motions with a pair of guide rods 31' and 31" providing stability and a variable stop.

It should be understood that either embodiment may be controlled automatically by a timer such that rodding occurs on a regular interval and that a computer system may be provided to monitor the furnace for such factors as carry-over, fume, and pressure differential and to actuate the apparatus to clear the ports responsive to preset threshold measurements thereof.

While varied forms of the invention have been described and illustrated, it is to be understood that the invention may be varied, within the scope of the claims, without departing from the spirit of the invention. Changes and innovations of this type are deemed to be circumscribed by the scope of the invention, except as the same may be necessarily limited by the claims.

Having set forth the nature of the present invention, what is claimed is:

1. Apparatus for cleaning and damping a port in a boiler comprising:

(a) means for iteratively urging a reciprocating plunger through at least one boiler port;

(b) means for damping said port; and (c) means connecting said damping means and said plunger for automatically displacing said damping means relative to said port responsive to reciprocating motion of said plunger.

2. Apparatus as defined in claim 1 wherein said means for urging comprises:

a linear actuator operatively connected to said plunger, guide means mounted for reciprocal concomitant and parallel motion with said plunger for maintaining alignment of said plunger with said port; and control means for advancing and retracting said linear actuator responsive to a predetermined signal.

3. Apparatus for cleaning and damping a port in a boiler comprising (a) means for iteratively urging a reciprocating plunger through at least one boiler port, comprising a linear actuator operatively connected to said plunger, guide means mounted for reciprocal, concomitant, and parallel motion with said plunger for maintaining alignment of said plunger with said port, and control means for advancing and retracting said linear actuator responsive to a predetermined signal, said control means comprising a timer operatively connected to a source of actuating fluid and said linear actuator to advance and retract said actuator at predetermined intervals, based on operative characteristics of said boiler, (b) means for damping said port; and (c) means connecting said damping means and said plunger for automatically displacing said damping means relative to said port responsive to reciprocating motion of said plunger.

4. Apparatus for cleaning and damping a port in a boiler comprising:

(a) means for iteratively urging a reciprocating plunger through at least one boiler port, comprising a linear actuator operatively connected to said plunger, guide means mounted for reciprocal concomitant and parallel motion with said plunger for maintaining alignment of said plunger with said port, and control means for advancing and retracting said linear actuator responsive to a predetermined signal, said control means comprising means for detecting particulate matter entrained in combustible gases in said boiler, means for quantifying the number of particles detected per unit of time and means for activating said linear actuator responsive to a quantity of particles detected per unit of time in excess of a threshold level, (b) means for damping said port; and (c) means connecting said damping means and said plunger for automatically displacing said damping means relative to said port responsive to reciprocating motion of said plunger.

5. Apparatus for cleaning and damping a port in a boiler comprising:

(a) means for iteratively urging a reciprocating plunger through at least one boiler port, said means for urging comprising a linear actuator operatively connected to said plunger and guide means for maintaining alignment of said plunger with said port;

(b) means for damping said port; and (c) means connecting said damping means and said plunger for automatically displacing said damping means relative to said port responsive to reciprocating motion of said plunger.

6. Apparatus as defined in claim 5 wherein said guide means comprises a rod slidably mounted within a sleeve fixedly mounted relative to said boiler parallel to the reciprocal motion of said plunger and a fixed link rigidly affixing said plunger to an end of said guide rod distal said sleeve.

7. Apparatus as defined in claim 6 wherein said damping means comprises a damper plate sized to be coextensive with the size of said port and means for mounting said plate for arcuate motion about an axis perpendicular to the movement of said reciprocating plunger, such that said plate is movable selectively to a clear position and a closed position.

8. Apparatus as defined in claim 7 wherein said connecting means comprises a link pivotally connected at a first and to said guide rod and pivotally connected at a second end to said mounting means such that concomitant reciprocal motion of said guide rod with said plunger urges said mounting means and port plate along an arcuate path about said axis.

9. Apparatus as defined in claim 8 wherein said mounting means comprises a rigid shroud affixed to said plate and pivotally symmetrical distal said plate on pin supported along said axis.

10. Apparatus as defined in claim 7 further comprising means affixed to said sleeve for selectively limiting the retraction of said guide rod such that said damping plate is selectively positioned relative to said port when said actuator is retracted.

11. In a boiler having a plurality of ports therein for supplying air to a furnace therein, said ports receiving air through a wind box, an improved apparatus for cleaning and damping selected one of said plurality of ports comprising:

(a) a reciprocating plunger assembly associated with each selected port mounted to said wind box and moving normal to said port;

(b) a damper pivotally mounted to said wind box proximal said plunger; and (c) connecting means operatively connecting said damper to said plunger assembly for concomitant movement of said damper relative to said port responsive to reciprocal movement of said plunger assembly such that said damper and said plunger are mutually exclusively positioned proximal said port.

12. In a boiler having a plurality of ports therein for supplying air to a furnace therein, said ports receiving air through a wind box, an improved apparatus for cleaning and damping selected one of said plurality of ports comprising:

(a) a reciprocating plunger assembly associated with each selected port mounted to said wind box and moving normal to said port, said plunger mounted to said wind box by a mounting flange having an aperture therethrough to accommodate said plunger, said mounting flange also having formed thereon a sleeve for receiving therein a pivot pin aligned perpendicular to the direction of motion of said plunger, said pivot pin supporting said damper, (b) a damper pivotally mounted to said wind box proximal said plunger; and (c) connecting means operatively connecting said damper to said plunger assembly for concomitant movement of said damper relative to said port responsive to reciprocal movement of said plunger assembly such that said damper and said plunger are mutually exclusively positioned proximal said port.

13. In a boiler having a plurality of ports therein for supplying air to a furnace therein, said ports receiving air through a wind box, an improved apparatus for cleaning and damping selected one of said plurality of ports comprising:

(a) a reciprocating plunger assembly associated with each selected port mounted to said wind box and moving normal to said port;

(b) a damper pivotally mounted to said wind box proximal said plunger, wherein said damper comprises a damper plate of sufficient size to obscure said port when placed in registry therewith and support members rigidly affixed to and extending from said damper plate to a pivotal connection with said wind box, said damping plate, support members and pivotal connection being positioned such that pivotal motion about said connection moves said damping plate between a port closed position and a port clear position, and (c) connecting means operatively connecting said damper to said plunger assembly for concomitant movement of said damper relative to said port responsive to reciprocal movement of said plunger assembly such that said damper and said plunger are mutually exclusively positioned proximal said port.

14. Apparatus as defined in claim 13 wherein said connecting means is pivotally connected between said support members and said plunger assembly distal said pivotal connection thereof to said wind box.

15. Apparatus as defined in claim 14 wherein said support members define a shroud including a top plate connected to the upper marginal edge of said damper plate and overlaying said plunger assembly, a pair of opposing side plates connected to opposing vertical marginal edges of said damper plate and to opposing longitudinal edges of said top plate and being spaced apart on either side of said plunger assembly, said side plates being pivotally supported distal said damper plate and supported by said connecting means proximal said damper plate.

16. Apparatus as defined in claim 13 wherein said plunger assembly comprises at least one puncher including a cleaning tip sized and oriented to pass through said port and substantially dislodge any occluding matter therefrom, a punching rod affixed at one end to said cleaning tip and coaxially to a linear actuator at an opposite end said linear actuator being mounted to said wind box and extending externally thereof.

17. Apparatus as defined in claim 16 wherein said plunger assembly further comprises:

(a) a guide rod slidably mounted in a guide sleeve extending through said wind box parallel to said punching rod and said linear actuator;

(b) a stabilizer link rigidly connecting said punching rod and said guide rod; and (c) means for adjusting the length of travel of said guide rod within said sleeve operably mounted to said sleeve externally of said wind box.

18. Apparatus as defined in claim 17, wherein said connecting means comprises a rigid link pivotally connected at one end to said stabilizer link subjacent said punching rod and extending upwardly to a second end pivotally connected to said supporting members such that retraction of said linear actuator causes said damper plate to be supported on said link in a closed port position intermediate said cleaning tip and said port and such that extension of said linear actuator causes said link to raise said damper plate to a port clear position above the line of travel of said cleaning tip.

19. Apparatus as defined in claim 2 wherein said control means is a timer operatively connected to a source of actuating fluid and said activator to advance and retract said actuator at predetermined intervals.

* * * * *